US009644833B1

(12) United States Patent
Householder

(10) Patent No.: US 9,644,833 B1
(45) Date of Patent: May 9, 2017

(54) ENCAPSULATED LED LIGHTING MODULE WITH INTEGRAL GAS VENTING

(71) Applicant: Universal Lighting Technologies, Inc., Madison, AL (US)

(72) Inventor: John R. Householder, Cedar Park, TX (US)

(73) Assignee: UNIVERSAL LIGHTING TECHNOLOGIES, INC., Madison, AL (US)

( * ) Notice: Subject to any disclaimer, the term of this patent is extended or adjusted under 35 U.S.C. 154(b) by 285 days.

(21) Appl. No.: 14/507,014

(22) Filed: Oct. 6, 2014

Related U.S. Application Data

(60) Provisional application No. 61/886,895, filed on Oct. 4, 2013.

(51) Int. Cl.

| | |
|---|---|
| ***F21V 31/03*** | (2006.01) |
| ***F21V 29/00*** | (2015.01) |
| ***F21V 17/06*** | (2006.01) |
| ***F21V 17/10*** | (2006.01) |
| *F21Y 101/02* | (2006.01) |
| *F21V 29/503* | (2015.01) |

(52) U.S. Cl.
CPC ..... *F21V 31/03* (2013.01); *F21V 17/06* (2013.01); *F21V 17/101* (2013.01); *F21V 29/22* (2013.01); *F21V 29/503* (2015.01); *F21Y 2101/02* (2013.01)

(58) Field of Classification Search
CPC ..... F21V 31/03; F21V 17/06; F21V 29/22; F21V 29/83; F21V 29/50; F21V 29/503; F21V 29/506; F21V 29/60
See application file for complete search history.

(56) References Cited

U.S. PATENT DOCUMENTS

| | | | | |
|---|---|---|---|---|
| 5,927,845 | A | 7/1999 | Gustafson et al. | |
| 7,808,004 | B2 | 10/2010 | Sun et al. | |
| 8,157,419 | B2 | 4/2012 | Hand et al. | |
| 8,338,839 | B2 | 12/2012 | Lerman et al. | |
| 2005/0213328 | A1* | 9/2005 | Matheson | F21K 9/00 362/267 |
| 2009/0154164 | A1* | 6/2009 | Hsu | F21S 8/00 362/267 |
| 2016/0153649 | A1* | 6/2016 | Wilcox | F21S 2/005 362/234 |

* cited by examiner

*Primary Examiner* — Anabel Ton
(74) *Attorney, Agent, or Firm* — Patterson Intellectual Property Law, PC; Mark J. Patterson; Garrett M. Hausman

(57) ABSTRACT

A lighting apparatus includes a substrate and a light source electrically connected to the substrate. A lens is positioned over the light source, the lens at least partially defining a space about the light source. A frame is connected to the substrate, the frame including a vent hole communicated with an exterior of the apparatus. A vent channel is at least partially defined between the lens and the substrate, the vent channel communicating the space about the light source with the vent hole. The vent channel and vent hole ventilate gases present in the space about the light source. An encapsulant at least partially covers the substrate and the lens. The frame can include an opening, the frame connected to a peripheral edge of the substrate with the substrate at least partially covering the opening. A heat sink can be contacted with the substrate.

19 Claims, 10 Drawing Sheets

ENCAPSULATED LED LIGHTING MODULE WITH INTEGRAL GAS VENTING

CROSS-REFERENCES TO RELATED APPLICATIONS

This application claims benefit of U.S. Patent Application No. 61/886,895, filed Oct. 4, 2013, entitled Encapsulated LED Lighting Module with Integral Gas Venting, which is incorporated herein by reference.

A portion of the invention of this patent document contains material that is subject to copyright protection. The copyright owner has no objection to the reproduction of the patent document or the patent invention, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to lighting systems which can be used to illuminate a desired area. More particularly, the present invention pertains to lighting systems with ventilation features to help ventilate a light source cavity.

Conventional lighting systems include a light source mounted on a substrate that is enclosed by a lens with the lens forming a cavity or space around the light emitter. When the lighting system is in use, the light source can produce a substantial amount of heat, which can raise the temperature inside the cavity or space. The increase in temperature produced by the light source can cause chemicals present in certain components of the lighting system such as adhesives, flux residues, or resins, to produce harmful gases. The gases produced can cause the lens of the lighting system to fog or discolor. The fogging or discoloration of the lens can attenuate the light passing through the lens, which can undesirably affect the illuminated appearance or overall light output of the lighting system. This problem is particularly prevalent in LED lighting systems, as LEDs conventionally produce a large amount of heat during operation.

In an attempt to combat this light attenuation, some conventional lighting systems may include a vent through an outer or top portion of the lens itself. Additionally, the vent in the lens includes a permeable material that allows the gases created during operation of the lighting system to escape. However, the cost of the permeable material as well as the difficulty in correctly placing and verifying proper placement of the vent directly in the lens is very high. Another disadvantage of these solutions is that the vent and the material inside the vent can distort the lit appearance or detract from the uniformity of the optical pattern of the lighting apparatus.

Additionally, many conventional lighting systems include a housing which can hold the other components of the lighting system. To improve thermal performance of the lighting systems, a heat management system or heat sink can be connected to the housing to dissipate heat away from the lighting apparatus, and particularly the substrate and the light source. However, several thermal interfaces can be positioned between the heat sink and the substrate, such that heat dissipating from the substrate must traverse several thermal interfaces before being dissipated to the heat sink. Such a configuration can make the thermal management system less efficient.

What is needed, then, are improvements in conventional lighting systems.

BRIEF SUMMARY OF THE INVENTION

One aspect of the present invention is a lighting apparatus including a substrate and a light source electrically connected to the substrate. A lens having a substrate mating surface can be attached to the substrate, the lens positioned over the light source and at least partially defining a space about the light source. A frame can be connected to the substrate, the frame including a vent hole communicated with an exterior of the apparatus. A vent channel can be at least partially defined between the substrate and the lens, the vent channel communicating the space around the light source with the vent hole in the frame. An encapsulant can at least partially cover the substrate and at least partially cover the lens. As such, harmful gases located inside the space about the light source can be vented through the vent channel and the vent hole in the frame to an exterior of the apparatus.

Another aspect of the present invention is a lighting apparatus including a substrate having a peripheral edge. A frame can include an opening. The frame can be connected to the peripheral edge of the substrate such that the substrate at least partially covers the opening in the frame. The frame can also include a vent hole communicated with an exterior of the apparatus. A light source can be electrically connected to the substrate. A lens can have a substrate mating surface attached to the substrate, the lens positioned over the light source such that the lens defines a space about the light source. The apparatus can further include a vent channel at least partially defined between the lens and the substrate. The vent channel can communicate the space around the light source with the vent hole in the frame. In some embodiments, the apparatus can further include a heat sink which can contact the substrate directly to help improve thermal performance of the lighting apparatus.

Another aspect of the present invention is a lighting apparatus including a substrate and a light source electrically connected to the substrate. A lens can have a substrate mating surface attached to the substrate. The lens can be positioned over the light source such that the lens at least partially defines a space about the light source. A frame can be connected to the substrate, the frame including a vent hole communicated with an exterior of the apparatus. A first vent channel can be at least partially defined between the lens and the substrate, the first vent channel communicating the space about the light source with the vent hole in the frame. A second vent channel can also be at least partially defined between the substrate and the lens.

One object of the present invention is to provide a ventilation system for harmful gases present in spaces about light sources in a lighting apparatus.

Another object of the present invention is to help improve thermal performance of lighting systems.

Numerous other objects, advantages and features of the present invention will be readily apparent to those of skill in the art upon a review of the following drawings and description of a preferred embodiment.

DETAILED DESCRIPTION

Figure 1:
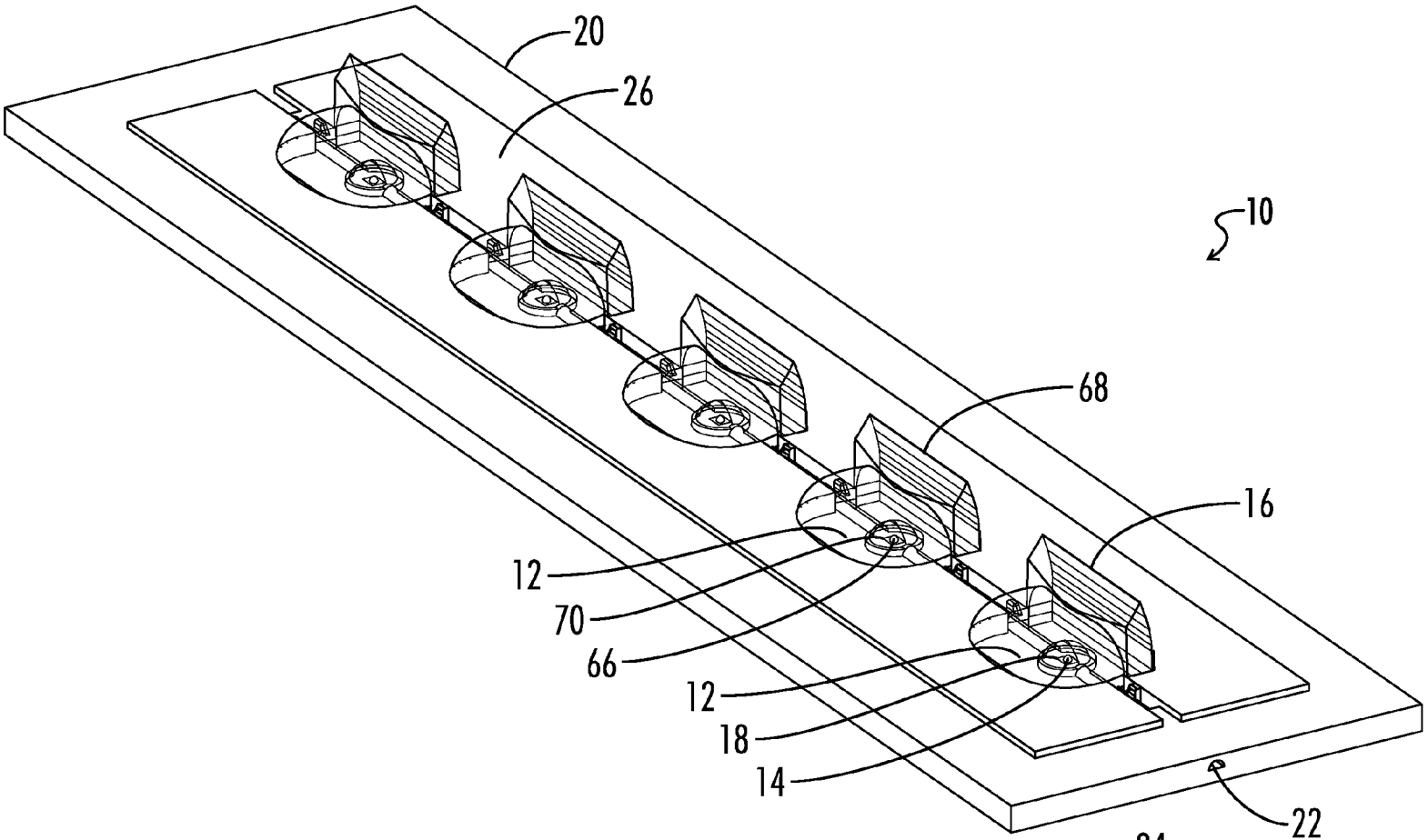
FIG. 1 is a perspective view of one embodiment of a lighting apparatus according to the present invention.

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified. The term "lateral" denotes a side to side direction when facing the "front" of an object.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

The apparatus and/or methods disclosed and claimed herein may be made and/or executed without undue experimentation in light of the present invention. While the apparatuses and methods of this invention have been described in terms of the embodiments included herein, it will be apparent to those of ordinary skill in the art that variations may be applied to the apparatuses and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

A perspective view of one embodiment of a lighting apparatus 10 is shown in FIG. 1. The lighting apparatus 10 can include a substrate 12 and a light source 14 electrically connected to the substrate 12. A lens 16 can be positioned over the light source 14. The lens 16 can at least partially define a space 18 about the light source 14. The lens 16 is shown in FIG. 1 as being transparent. A frame 20 can be connected to substrate 12. The frame 20 can include a vent hole 22 communicated with an exterior 24 of the apparatus 10. An encapsulant 26 can at least partially cover the substrate 12 and at least partially cover the lens 16.

The encapsulant 26 can help provide a seal between the lens 16 and the substrate 12 to help prevent liquids or other contaminants from being introduced into the space 18 about the light source 14. This can help protect the integrity of the light source 14 and the performance and longevity of the lighting apparatus 10. The encapsulant 26 can also help adhere the lens 16 to the substrate 12 so that the lens 16 remains in a proper position on the substrate 12 over the light source 14. The encapsulant 26 can also help provide rigidity to the substrate 12 and the apparatus 10. In some embodiments, the encapsulant 26 can be contained within the frame 20. In other embodiments, as shown in FIG. 1, the encapsulant 26 can extend over the frame 20 such the encapsulant can adhere the frame 20 to the substrate 12 and the lens 16.

The lens 16 at least partially defines the space 18 about the light source 14. In some embodiments, the lens 16 can be attached to the substrate 12. As such, the space 18 can be substantially defined between the lens 16 and the substrate 12. The light source 14 can be configured to project light through the lens 16 toward a desired or target area. The shape of the lens 16 can be configured to produce different lit appearances for different applications. For example, in some embodiments, the lens 16 can be an asymmetrical lens for use in a directional lighting system, as shown in FIG. 1. In some embodiments, the lens 16 can have a dome-like shape. In other embodiments the lens 16 can include diffusers, micro lenses, micro prisms, Fresnel Patterns, or kinoforms to produce different lighting profiles. In some embodiments, the lens 16 can be formed of a heat-resistant plastic material such as a polycarbonate, a glass material, or any other suitable material known in the art.

The substrate 12 can be formed of any material that is suitable to serve as a foundation upon which an electronic device can be mounted. Such materials can include, but are not limited to, a printed circuit board, metal clad circuit board, silicon, silicon dioxide, aluminum dioxide, sapphire, germanium, gallium arsenide, an alloy of silicon and germanium, indium phosphide or any other suitable material known in the art.

In some embodiments, the light emitter 14 can be a light emitting device including, but not limited to, LEDs, incandescent bulbs, lamps, light globes, fluorescent lamps or tubes, arc lamp, sulfur lamp or any other suitable light emitting device known in the art.

Figure 2:
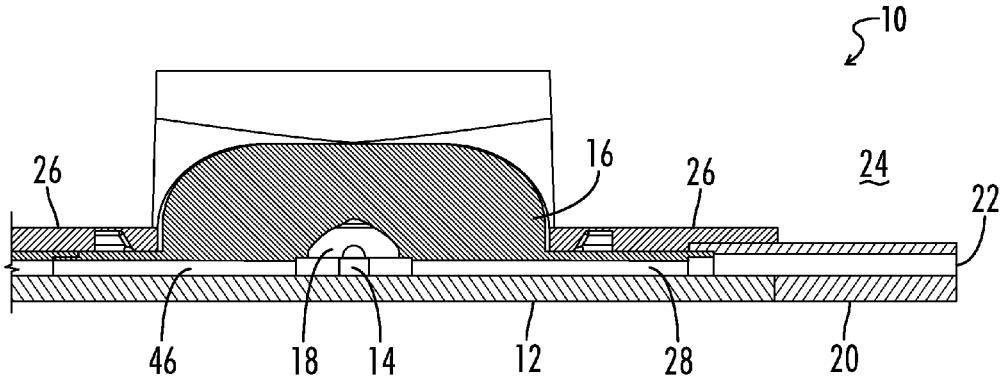
FIG. 2 is a an partial cross-sectional view of the lighting apparatus of FIG. 1

A partial cross-sectional view of the lighting apparatus 10 of FIG. 1 is shown in FIG. 2. A vent channel 28 can be at least partially defined between the lens 16 and the substrate 12. The vent channel 28 can communicate the space 18 about the light source 14 and the vent hole 22 in the frame 20. As such, a pathway is created from the space 18 about the light emitter 14 through the vent channel 28 and the vent hole 22 to an exterior 24 of the apparatus 10.

The vent channel 28 and the vent hole 22 can be configured to vent the space 18 about the light source 12. During operation of the lighting apparatus 10, the light source 14 can produce a considerable amount of heat which in turn can heat the area around the light source 14 and the substrate 12. The area around the light source 14 and the substrate 12 can include a number of chemicals which are components of adhesives, sealants, or other resins present on the apparatus 10. As these chemicals are heated during operation, the chemicals can produce gases which can be retained in the space 18 about the light source 14. These gases can be harmful to the integrity of the lens 16 and can cause the lens 16 to fog or discolor. Discoloration or fogging of the lens 16 can result in attenuation of the light being emitted by the light source 14 as the light passes through the lens 16, which can reduce the amount of light that ultimately reaches the target area. Thus, the output of the apparatus 10, as well as the lit appearance, can be affected by the accumulation of gases within the space 18. This problem is particularly prevalent in LED lighting systems, as LEDs typically produce a substantial amount of heat while in use.

As the temperatures of the light emitting apparatus 10 and the space 18 about the light emitter 14 increase, the pressure inside the space 18 can also increase. Additionally, gases produced by chemicals on the light emitting apparatus 10 can be retained in the space 18, which can further increase the pressure within the space 18. This increase in pressure can place significant stress on the components of the light emitting apparatus 10, and can result in a reduction in productivity, efficiency, and longevity.

Gases can be vented from the space 18 through the vent channel 28 and the vent hole 22 in the frame 20 such that the gases can be expelled to an exterior 24 of the apparatus 10. Venting of the gases contained within the space 18 about the light emitter 14 can help reduce discoloration or fogging of the lens 16 caused by the harmful gases. Additionally, ventilation of the space 18 can help reduce the pressure within the space 18.

Figure 3:
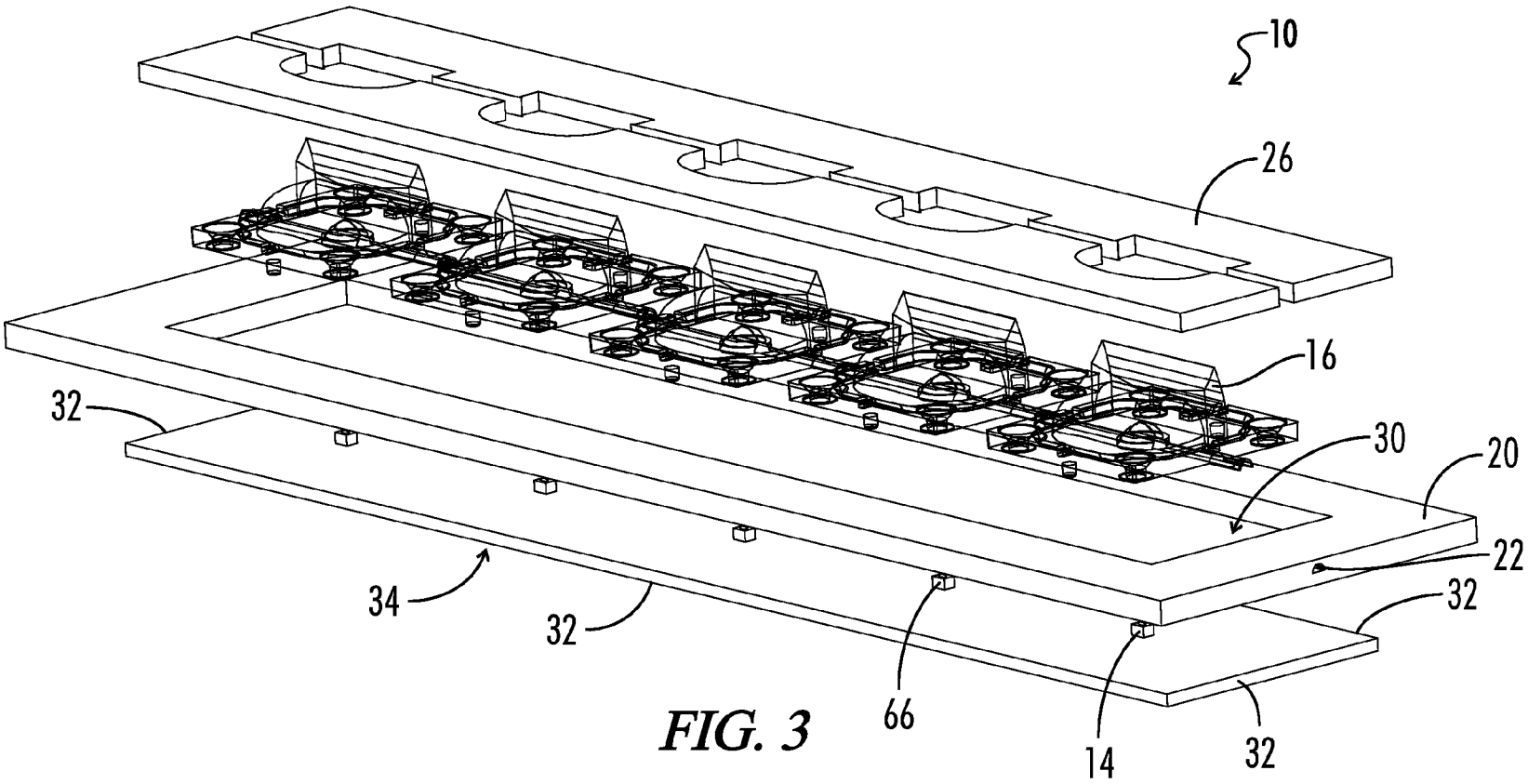
FIG. 3 is an exploded view of the lighting apparatus of FIG. 1.

An exploded view of the lighting apparatus 10 shown in FIG. 1 is shown in FIG. 3. In some embodiments, the frame 20 can include an opening 30. The substrate 12 can also include a peripheral edge 32. The frame 20 can be connected to at least a portion of the peripheral edge 32 of the substrate 12 such that the substrate 12 at least partially covers the opening 30 in the frame 20. As such, a bottom surface 34 of the substrate 12 can generally be exposed.

Figure 4:
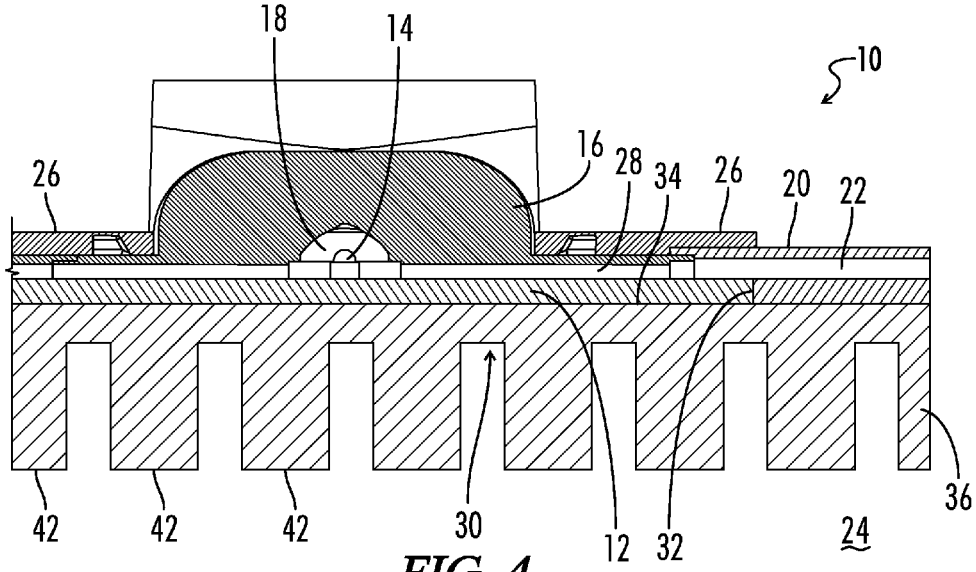
FIG. 4 is a partial cross-sectional view of another embodiment of a lighting apparatus including one embodiment of a heat sink.

A partial cross-sectional view of another embodiment of a lighting apparatus 10 including a heat sink 36 is shown in FIG. 4. The frame 20 can be connected to the peripheral edge 32 of the substrate 12 such that substrate 12 at least partially covers the opening 30 in the frame 20. The heat sink 36 can then be positioned to contact the substrate 12 directly. As such, the heat sink 36 can help dissipate heat from the substrate 12, and ultimately the light source 14, directly. In FIG. 4, the heat sink 36 contacts the bottom surface 34 of the substrate, which is accessible because of the opening 30 in the frame 20. The heat sink 36 in FIG. 4 includes multiple fins 42 which can help increase the amount of surface area exposed to an exterior of the apparatus 24, which can help increase dissipation of heat from the heat sink 36 to the exterior 24 of the apparatus, and thereby increase heat dissipation away from the substrate 12. The heat sink 36 shown in FIG. 4 is just one embodiment of a heat sink 36, and the heat sink 36 can be any suitable shape or structure that can help dissipate heat away from the substrate 12 and the apparatus 10.

Many conventional lighting systems can include a housing or frame with the substrate situated entirely within the housing or frame. As such, a heat sink or other thermal management system must dissipate heat from the substrate via the housing. Heat must then pass across a thermal interface between the substrate and the housing, and then again over a thermal interface between the housing and the heat sink. Such a configuration can be inefficient in dissipating heat away from the substrate. In the apparatus 10 shown in FIG. 4, the heat sink 36 makes direct contact with the substrate 12 such that heat is passed directly from the substrate 12 to the heat sink 36. Such a configuration can help increase the thermal efficiency of the lighting apparatus 10. Increasing the thermal efficiency of the apparatus 10 can help reduce the temperature of the apparatus 10, which can help lower the amount of harmful gases being produced and contained within the space 18 about the light source 14.

The heat sink 36 can be formed of any suitable material that can be configured to act as a heat exchanger. These materials can include, but are not limited to, aluminum alloys such as 1050A, 6061, or 6063, copper, diamond, composite materials such as copper tungsten pseudoalloy, graphite, silicon carbide in aluminum matrix (AlSiC), diamond in copper-silver alloy matrix (Dymalloy), beryllium oxide in beryllium matrix, or any other suitable materials known in the art.

While the apparatus 10 can include a heat sink 36 connected to the substrate 12, in some embodiments, the frame 20 can additionally be constructed from a thermally conductive material such as the materials previously noted for the heat sink 36. As such, the frame 20 can further help dissipate heat away from the substrate 12 and the apparatus 10.

Figure 5:
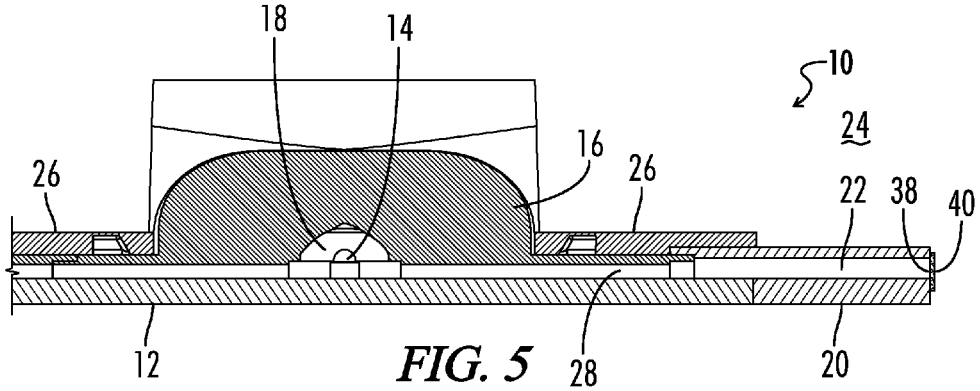
FIG. 5 is a partial cross-sectional view of another embodiment of a lighting apparatus including one embodiment of a breathable barrier over an exit opening of a vent hole in a frame.

Another embodiment of a lighting apparatus 10 is shown in FIG. 5. The vent hole 22 in the frame 20 can have an exit opening 38. The apparatus 10 can further include a breathable barrier 40 communicated with the exit opening 38 of the vent hole 22. The breathable barrier 40 can be configured to prevent liquid and dust from entering into the vent hole 22 and the vent channel 28, which can help keep the space 18 about the light source 14 and the light source 14 free from liquids and dust. As such, the breathable barrier 40 can help protect the efficiency and longevity of the light source 14 and the lighting apparatus 10. The breathable barrier 40 can also be configured to allow air or gases to pass through the breathable barrier 40 such that the space 18 about the light source 14 can be properly ventilated through the vent channel 28 and the vent hole 22. Thus, the breathable barrier 40 can allow gases to pass through the vent hole 22 while preventing liquid and dust from entering the vent hole 22. The breathable barrier 40 can be a Porex™ patch or any other suitable material known in the art that can allow gases to pass through the vent channel 28 and the vent hole 22 while preventing liquids and dust from entering into the vent hole 22.

Figure 6:
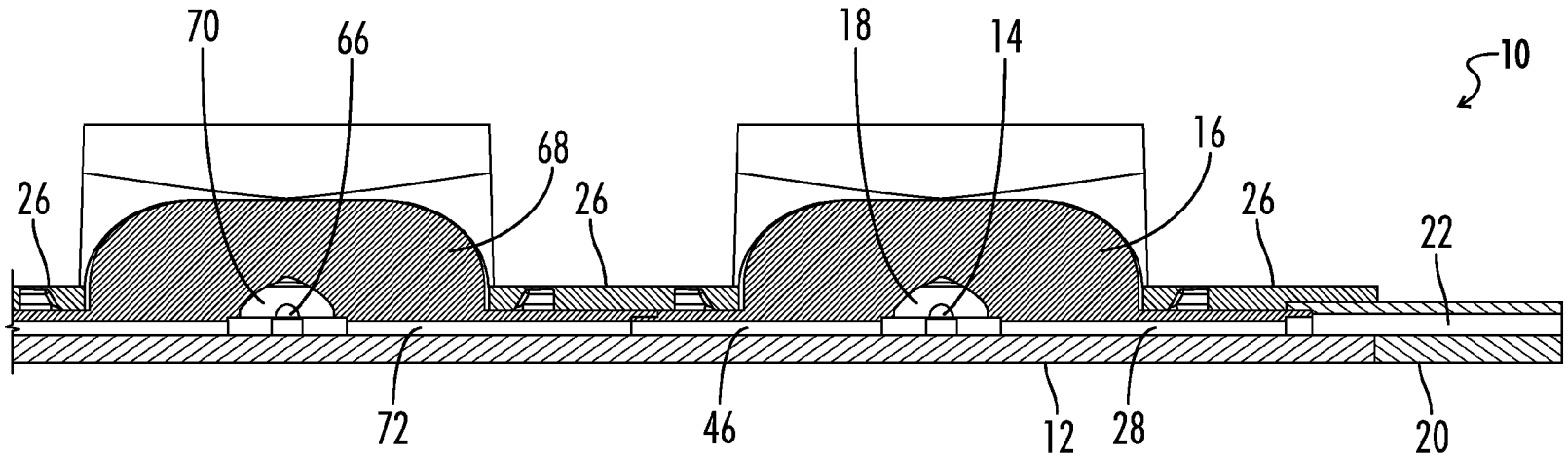
FIG. 6 is another partial cross sectional view of the lighting apparatus of FIG. 1 showing ventilation of two light sources.

Referring again to FIG. 1, in some embodiments, the apparatus 10 can further include a second light source 66. A second lens 68 can be positioned over the second light source 66, the second lens 68 defining a second space 70 about the second light source 66. A second partial cross-sectional view of the embodiment of FIG. 1 showing the first and second light sources 14 and 66 is seen in FIG. 6. The apparatus 10 can include a second vent channel 46 at least partially defined between the lens 16 and the substrate 12. The second vent channel 46 can be communicated with the space 18 about the light source 14.

Additionally, the apparatus 10 can include a second lens vent channel 72 at least partially defined between second lens 68 and the substrate 12. The second lens vent channel 72 can be communicated with the second space 70 about the second light source 66. The second lens vent channel 72 can be communicated with the second vent channel 46, such that the second lens vent channel 72 communicates the second space 70 about the second light source 66 with the second vent channel 46. A pathway is thereby formed interconnecting and communicating the second space 70 about the second light emitter 66, the second lens vent channel 72, the second vent channel 46, the space 18 about the light source 14, the vent channel 28, and the vent hole 22. Gases present in either the space 18 about the light source 14 or the second space 70 about the second light source 66 can travel along the pathway interconnecting the different vent channels and spaces and exit out of the vent hole 22 to an exterior 24 of the apparatus 10.

Figure 7:
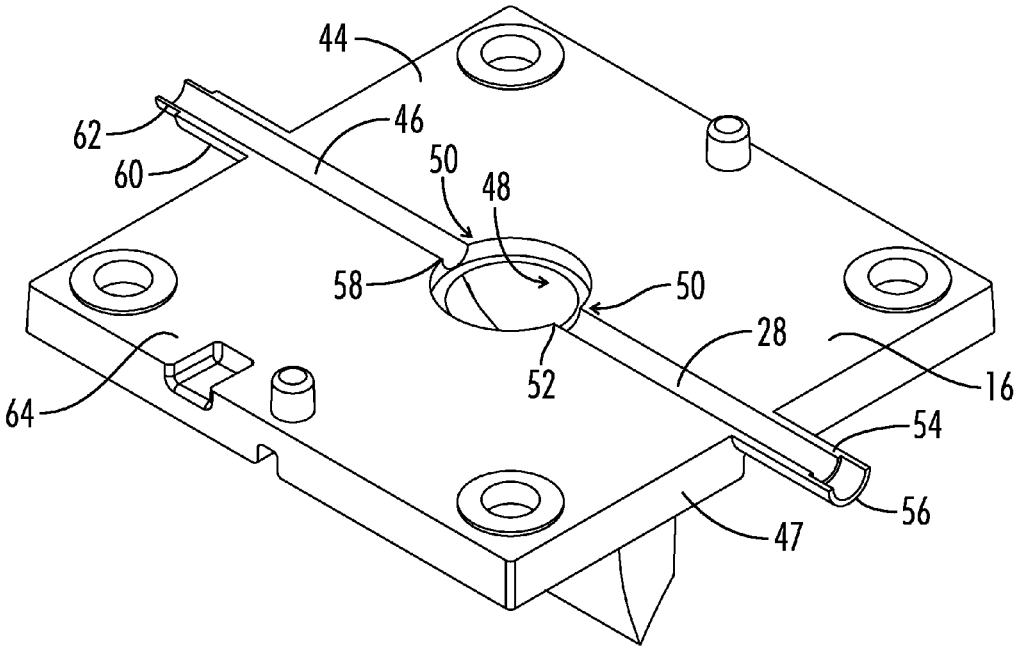
FIG. 7 is a bottom perspective view of a lens seen in FIG. 1.
Figure 8:
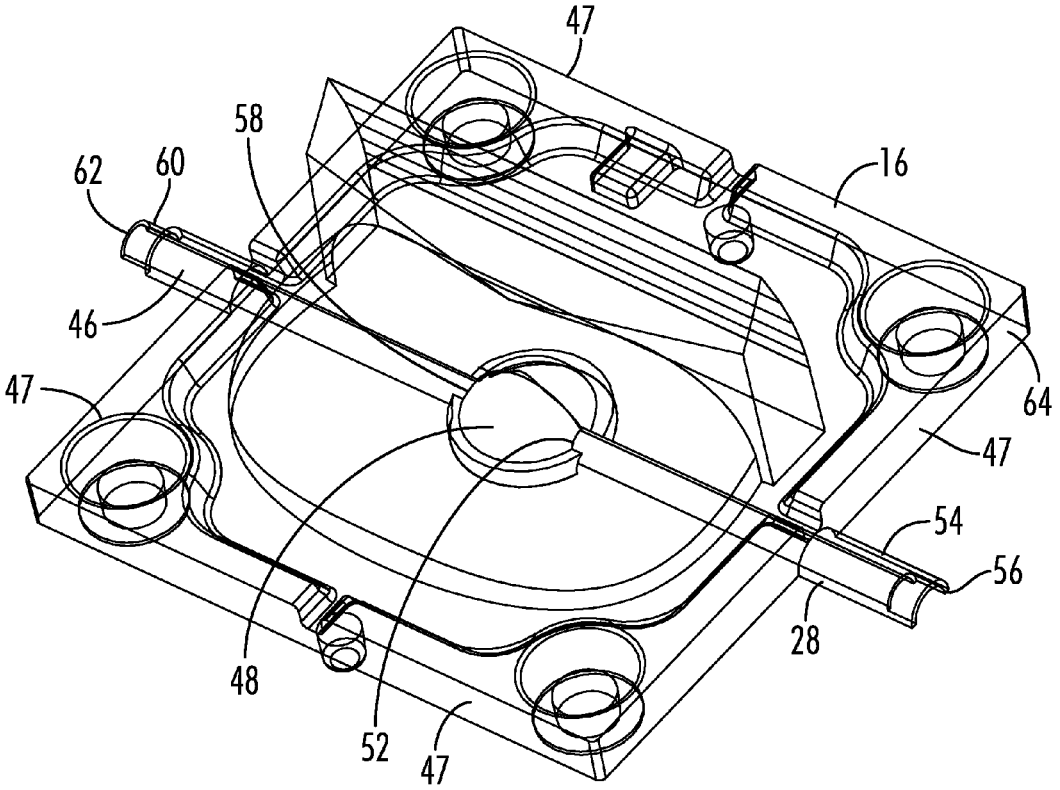
FIG. 8 is a perspective view of a lens seen in FIG. 1.

An embodiment of a lens 16 of the apparatus 10 shown in FIG. 1 is shown in FIG. 7 and FIG. 8. In some embodiments, the lens 16 can include a lens flange 47. The lens flange 47 can be used to attach the lens 16 to the substrate. Additionally, in those embodiments including an encapsulant at least partially covering the lens 16 and the substrate, the encapsulant can engage the lens flange 47 to adhere the lens 16 to the substrate. The lens flange 47 can provide one or more substantially horizontal surfaces which can provide a larger area of contact between the lens 16 and the encapsulant. As such, a stronger and more reliable seal can be formed between the lens 16 and the substrate.

A bottom view of an embodiment of a lens from FIG. 1 is shown in FIG. 7. In some embodiments, the lens 16 can include a substrate mating surface 44. In some embodiments, the vent channel 28 can be defined in the substrate mating surface 44 of the lens 16. Accordingly, the lens 16 can be manufactured with the vent channel 28 defined in the lens 16 such that when the lens 16 is positioned on the substrate 12 as shown in FIG. 2, the vent channel 28 can be formed and defined between the lens 16 and the substrate 12. The vent channel 28 can be milled, injection molded, extrusion molded, or otherwise manufactured into the lens 16. In other embodiments, the vent channel 28 can be defined in the substrate 12 such that when the lens 16 is positioned over the light source 14, the vent channel 28 is formed and defined between the substrate 12 and the lens 16.

In some embodiments, as shown in FIG. 7, the second vent channel 46 can also be defined in the substrate mating surface 44 of the lens 16, such that both the vent channel 28 and the second vent channel 46 can be defined in the lens 16. In some embodiments, as shown in FIG. 7 and FIG. 8, the vent channel 28 and the second vent channel 46 can extend in opposite directions from a cavity 48 defined in the lens 16, the cavity 48 defining the space about the light source when the lens is in position over the light source. When the lens 16 is positioned over the light source, vent channel 18 and second vent channel 46 can extend in opposite directions from the space about the light source. Additionally, in some embodiments, the vent channel 28 and the second vent channel 46 can be communicated with opposing sides 50 of the cavity 48, such that when the lens 16 is positioned over the light source 14 the vent channel 28 and the second vent channel 46 are communicated with opposing sides of the space about the light source.

In some embodiments, the vent channel 28 can have a first end 52 and a second end 54. The first end 52 of vent channel 28 can be communicated with cavity 48 and the space about the light source when the lens 16 is in position over the light source. The second end 54 can be coupled with a female coupling member 56. Similarly, the second vent channel 46 can have a second vent channel first end 58 and a second vent channel second end 60. The second vent channel first end 58 can be communicated with the cavity 48 and the space about the light source when the lens 16 is in position over the light source. The second vent channel second end 60 can be coupled with a male coupling member 62. In some embodiments, both the second end 54 of the vent channel 28 and the second vent channel second end 60 can extend outward from a main body 64 of the lens 16. In other embodiments, the second end 54 of the vent channel 28 can be coupled with a male coupling member, and the second vent channel second end 60 can be coupled with a female coupling member.

Figure 9:
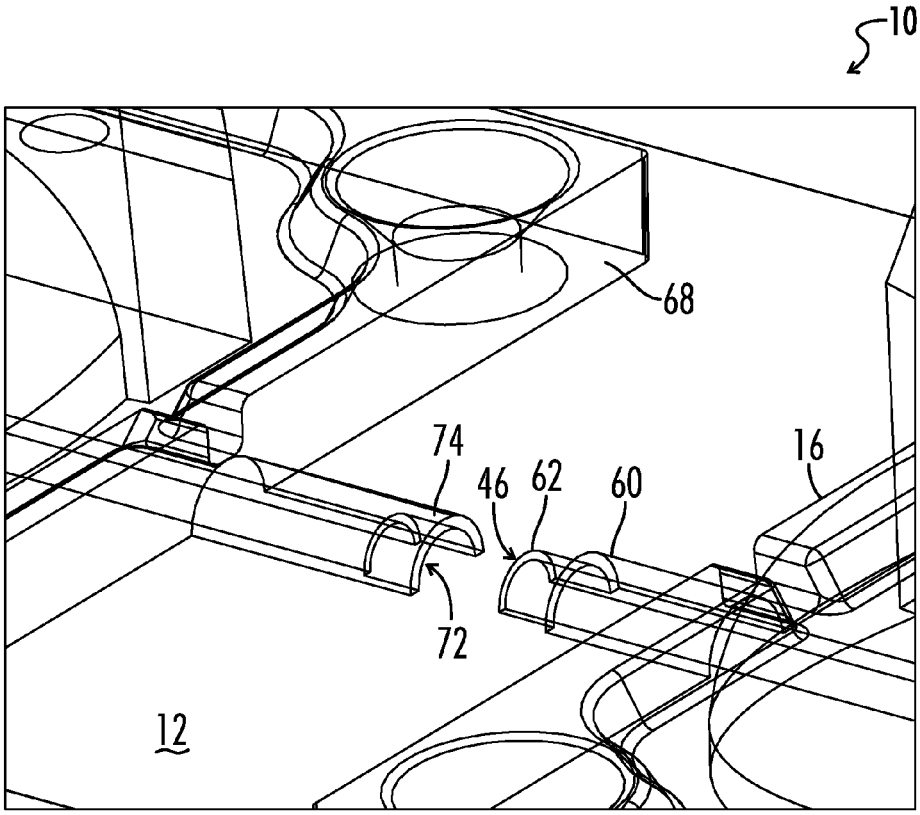
FIG. 9 is a detailed perspective view of an embodiment of multiple vent channels being coupled together.

Multiple lenses 16 similar to the lens 16 in FIGS. 7 and 8 can be positioned on the substrate with the vent channels defined between the different lenses and the substrate coupled together. As shown in FIG. 9, a male coupling member 62 can be associated with the second vent passage 46 defined between the lens 16 and the substrate 12. A female coupling member 74 can be associated with a second lens vent channel 72 defined between the second lens 68 and the substrate 12. The male coupling member 62 can be inserted into the female coupling member 74, effectively coupling the male coupling member 62 and the female coupling member 74. As such, the second vent channel 46 can be communicated with the second lens vent channel 72.

Figure 10:
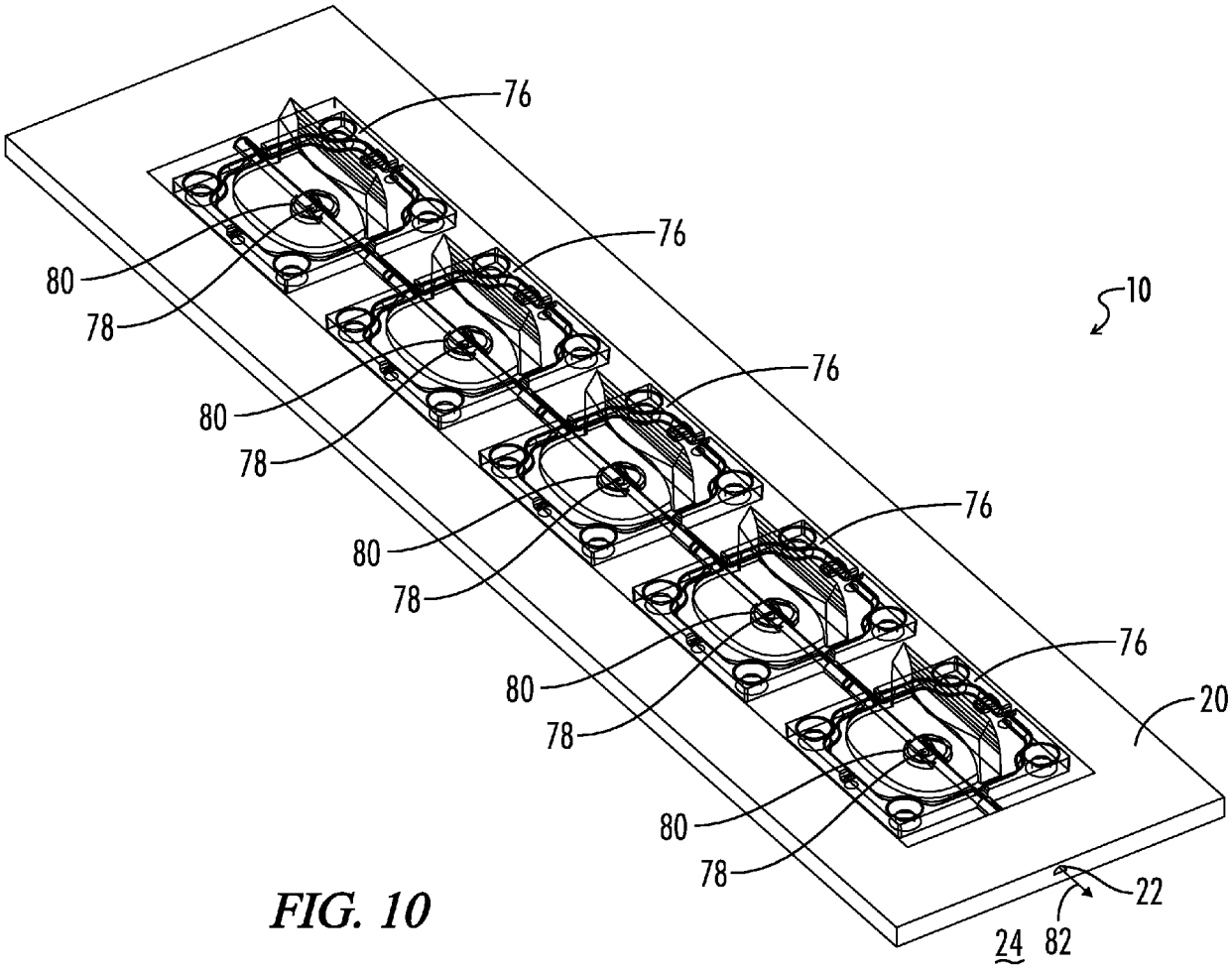
FIG. 10 is a perspective view of the lighting apparatus of FIG. 1 with an encapsulant removed.

The apparatus of FIG. 1 is shown in FIG. 10 with the encapsulant removed. From FIG. 10 it can be seen that a plurality of lenses 76 can be positioned over a plurality of light sources 78 to form a plurality of corresponding spaces 80 about the plurality of light sources 78. The plurality of lenses 76 can be connected together via the respective coupling members as previously described for FIG. 9 such that a ventilation path 82 is formed. The ventilation path 82 communicates each of the spaces 80 about the plurality of light sources 78 with the vent hole 22 in the frame 20, which can help ventilate harmful gases from each of the plurality of corresponding spaces 80. In some embodiments, the plurality of lenses 76 and the plurality of light sources 78 can include multiple rows of lenses and corresponding light sources. Each row can form a corresponding ventilation path communicating the corresponding spaces in each row of lenses and light sources with a vent port 22. Multiple ventilation paths can be communicated with the same vent port 22, or the frame 20 can include multiple vent ports, each ventilation path being communicated with a corresponding vent port in the frame 20.

Figure 11:
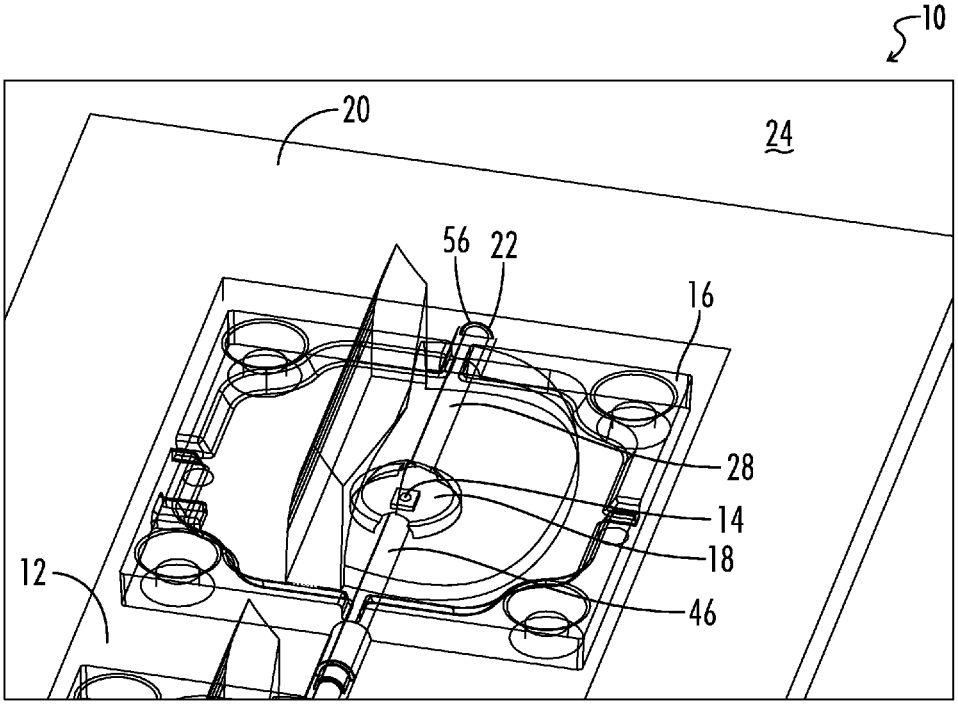
FIG. 11 shows a detailed perspective view of one embodiment of a vent channel being communicated with a vent hole in a frame.

As can be seen from FIG. 11, the vent channel 28 defined between the lens 16 and the substrate 12 can be communicated with the vent hole 22 such that gases passing through the vent channel 28 can be expelled to an exterior 24 of the apparatus 10. In some embodiments, the vent hole 22 can have a complementary shape to a coupling member 56 associated with the vent channel 68 such that coupling member 56 can be received in the vent hole 22, effectively coupling the vent channel 28 with the vent hole 22.

Thus, although there have been described particular embodiments of the present invention of a new and useful Encapsulated LED Lighting Module with Integral Gas Venting it is not intended that such references be construed as limitations upon the scope of this invention except as set forth in the following claims.

What is claimed is:

1. A lighting apparatus comprising:

a substrate;

a light source electrically connected to the substrate;

a lens positioned over the light source, the lens at least partially defining a space about the light source;

a frame connected to the substrate, the frame including a vent hole, the vent hole communicated with an exterior of the lighting apparatus;

a vent channel at least partially defined between the lens and the substrate, the vent channel communicating the space about the light source with the vent hole in the frame; and an encapsulant at least partially covering the substrate and at least partially covering the lens, the encapsulant defining a seal between the substrate and the lens.

2. The apparatus of claim 1, wherein:

the substrate includes a peripheral edge; and the frame has an opening, the frame connected to at least a portion of the peripheral edge of the substrate, the substrate at least partially covering the opening.

3. The apparatus of claim 2, wherein the apparatus further comprises a heat sink contacting the substrate.

4. The apparatus of claim 1, wherein:

the lens includes a substrate mating surface; and the vent channel is defined in the substrate mating surface of the lens.

5. The apparatus of claim 1, wherein:

the vent hole further comprises an exit opening communicated with an exterior of the apparatus; and the apparatus further comprises a breathable barrier communicated with the exit opening, the breathable barrier configured to allow gases to pass through the vent hole while preventing liquid and dust from entering the vent hole.

6. The apparatus of claim 1, wherein the apparatus further comprises a second vent channel at least partially defined between the lens and the substrate, the second vent channel communicated with the space about the light source.

7. The apparatus of claim 6, wherein the vent channel and the second vent channel extend in opposite directions from the space defined about the light source.

8. The apparatus of claim 6, wherein:

the vent channel has a first end and a second end, the first end communicated with the space about the light source, the second end coupled with a female coupling member; and the second vent channel has a second vent channel first end and a second vent channel second end, the second vent channel first end communicated with the space about the light source, the second vent channel second end coupled with a male coupling member.

9. The apparatus of claim 6, further comprising:

a second light source electrically connected to the substrate;

a second lens positioned over the second light source, the second lens at least partially defining a second space about the second light source; and a second lens vent channel at least partially defined between the second lens and the substrate, the second lens vent channel communicating the second space about the second light source with the second vent channel.

10. The apparatus of claim 1, wherein the frame comprises a thermally conductive material.

11. A lighting apparatus comprising:

a substrate having a peripheral edge;

a frame having an opening, the frame connected to at least a portion of the peripheral edge of the substrate, the substrate at least partially covering the opening in the frame, the frame having a vent hole communicated with an exterior of the apparatus;

a light source electrically connected to the substrate;

a lens positioned over the light source, the lens at least partially defining a space about the light source; and a vent channel at least partially defined between the lens and the substrate, the vent channel communicating the space about the light source with the vent hole in the frame.

12. The apparatus of claim 11, further comprising an encapsulant at least partially covering the substrate and at least partially covering the lens, the encapsulant providing a seal between the substrate and the lens.

13. The apparatus of claim 11, further comprising a heat sink in direct contact with the substrate.

14. The apparatus of claim 11, further comprising a second vent channel at least partially defined between the lens and the substrate, the second vent channel communicated with the space about the light source.

15. A lighting apparatus comprising:

a substrate;

a light source electrically connected to the substrate;

a lens positioned over the light source, the lens at least partially defining a space about the light source;

a frame connected to the substrate, the frame including a vent hole, the vent hole communicated with an exterior of the apparatus;

a first vent channel at least partially defined between the lens and the substrate, the first vent channel communicating the space about the light source with the vent hole in the frame; and a second vent channel at least partially defined between the lens and the substrate, the second vent channel communicated with the space about the light source.

16. The apparatus of claim 15, further comprising:

a second light source electrically connected to the substrate;

a second lens positioned over the second light source, the second lens at least partially defining a second space about the second light source; and a second lens vent channel at least partially defined between the second lens and the substrate, the second lens vent channel communicating the second space about the second light source with the second vent channel.

17. The apparatus of claim 16, wherein the second vent channel and the second lens vent channel are coupled together.

18. The apparatus of claim 15, further comprising an encapsulant at least partially covering the substrate and at least partially covering the lens.

19. The apparatus of claim 15, wherein the first vent channel and the second vent channel are communicated with opposing sides of the space about the light source.

* * * * *